United States Patent [19]

Viessmann

[11] 4,183,394

[45] Jan. 15, 1980

[54] METHOD AND APPARATUS FOR HORIZONTAL CONTINUOUS CASTING

[75] Inventor: Klaus Viessmann, Marbach-Rielinghausen, Fed. Rep. of Germany

[73] Assignee: Kreidler Werke GmbH, Fed. Rep. of Germany

[21] Appl. No.: 860,470

[22] Filed: Dec. 14, 1977

[30] Foreign Application Priority Data

Dec. 17, 1976 [DE] Fed. Rep. of Germany ..... 2657207

[51] Int. Cl.[2] ..... B22D 21/02; B22D 11/00

[52] U.S. Cl. ..... 164/66; 164/415; 164/440

[58] Field of Search ..... 164/66, 73, 74, 82, 164/259, 415, 440

[56] References Cited

U.S. PATENT DOCUMENTS

| | | | |
|---|---|---|---|
| 3,623,536 | 11/1971 | Moritz | 164/440 |
| 3,630,266 | 12/1971 | Watts | 164/82 |
| 3,726,336 | 4/1973 | Moritz | 164/440 |

FOREIGN PATENT DOCUMENTS

| | | | |
|---|---|---|---|
| 1104124 | 4/1961 | Fed. Rep. of Germany | 164/83 |

*Primary Examiner*—Robert D. Baldwin
*Assistant Examiner*—K. Y. Lin
*Attorney, Agent, or Firm*—Steinberg & Blake

[57] ABSTRACT

A method and apparatus for horizontal continuous casting of metal alloys, such as brass, which tend to have a component thereof separate therefrom, in vapor form, during and immediately after solidification of the metal. The molten metal alloy progresses from the entrance end toward the discharge end of a horizontal tubular mold, with the metal solidifying at least next to the inner surface of the mold before reaching the discharge end thereof. The solidified metal in the mold shrinks inwardly away from the mold surface to form a shrinkage gap therewith, so that the above component of the alloy in vapor form enters into this shrinkage gap. In accordance with the invention this shrinkage gap is maintained filled with a gas which is inert to the above vapor so that the latter cannot oxidize in the shrinkage gap. In this way it is possible to avoid formation of undesirable deposits at the inner surface of the mold.

5 Claims, 3 Drawing Figures

METHOD AND APPARATUS FOR HORIZONTAL CONTINUOUS CASTING

BACKGROUND OF THE INVENTION

The present invention relates to continuous casting of metal alloys.

In particular, the present invention relates to horizontal continuous casting of metal alloys which during and immediately subsequent to solidifying tend to have a component thereof separate from the metal in vapor form.

The present invention relates in particular to the continuous horizontal casting of a brass alloy as well as to an apparatus for carrying out the method of horizontal casting.

During continuous casting of alloys of the above type it is difficult to achieve faultless elongated castings during long periods of operation. Such castings have cracks and rough portions at their exterior surface while also having a diameter which diminishes in size along the length of the casting. The reason for these drawbacks resides in the fact that during and shortly after solidification of the metal alloy a component thereof separates therefrom in vapor form, and this vapor results in deposits at the inner surface of the mold. In fact it has been observed that during continuous casting of such alloys there is a deposition out of the glowing casting, this deposition resulting in formation of deposits which cling very tightly to the inner surface of the mold. As a result of these deposits, the resistance to travel of the metal through the mold at the region where the metal still engages the inner surface of the mold continuously increases, so that to an increasing extent as the molding operation continues there are formation of cracks in the surface of the casting, with the still relatively thin skin of solidified metal at the outer portion of the casting tending to fuse itself together to a greater or lesser extent where such cracks are formed, and with the diameter of the casting progressively becoming of a smaller size.

As a result, aside from frequent changes of the mold, it is necessary before further operations are performed on such castings to remove from the outer surface thereof a layer of metal having a thickness of several millimeters, so that the result is additional labor costs and loss of material.

During vertical continuous casting where the mold is independent of a furnace, or in other words with an open mold, it is possible to some extent to avoid these drawbacks by providing at the surface of the molten metal suitable lubricating and separating agents which will at least to some extent avoid the formation of such deposits. Thus, with such measures it is possible to obtain a satisfactory product at least with relatively large-diameter castings.

When continuous casting is carried out with an alloy such as, for example, brass, it is already known that it is advisable to cover the surface of the molten metal at the top of the vertical mold with a combustible gas. For this purpose use is made of a burner having ring-shaped slots and arranged with respect to the surface of the molten metal in such a way that the combustible gas is delivered in the form of an uninterrupted film against the inner surface of the mold, so as to achieve in this way a protective atmosphere which prevents oxidation of the molten metal surface.

Also, in order to provide and maintain a protective atmosphere it is known to utilize a partially removable hood charged with a protective gas from lateral pipes, with this hood being arranged over the supply pipes, troughs for the molten metal, and mold in such a way that upon raising part of the hood so as to obtain access to the troughs the supply pipes still remain beneath the protective gas.

However, the fact is that measures of the above type are limited only to vertical continuous casting. Such procedures cannot be used with horizontal continuous casting which to an increasing extent is being more widely utilized because of the relatively small vertical space which is required by a horizontal casting apparatus and because of the uninterrupted nature of the operation of a horizontal continuous casting apparatus.

It is also known when carrying out vertical continuous casting with a mold which is independent of a furnace, to provide a combustible, carbon-containing gas between the freshly-formed casting skin of the solidifying metal and the surface of the mold at a location beneath the elevation where the metal starts to solidify, this latter combustible, carbon-containing gas being supplied with an amount of air which is insufficient for combustion of the gas so that as a result of the incomplete combustion carbon deposits itself between the skin of the solidifying casting and the mold to serve as a lubricant. In accordance with other operating procedures, it is known to feed into the space between the shrinking casting and the mold a gas under pressure together with oil or other lubricant, with this gas being an inert gas such as nitrogen or hydrogen. These procedures of course represent attempts to maintain the solidifying metal as well as the molten metal of the runner away from the mold wall by way of the lubricant or, in some cases, the layer of inert gas.

In addition, access of the slag between the metal and mold wall is to be avoided. In order to maintain the pressure required for this purpose, and in any case in order to be sure that the gas flows upwardly, an annular seal is provided at the discharge end of the vertical mold, surrounding the casting which issues downwardly through this discharge end.

However, such measures cannot be used with horizontal continuous casting where the mold must be in communication with the furnace or other source of molten metal. The result of utilizing such measures in horizontal continuous casting is that the lubricant and gas reaches the molten metal and forms therein inclusions of carbon, gaseous expansions and blowholes, which during the continuing casting operation travel into the solidifying casting to form undesirable foreign bodies therein as well as cavitations and blowholes. Thus it is impossible to achieve a faultless inner structure or matrix for such castings, and the result is that all that remains to be achieved is at least a clean, crack-free outer surface for the elongated casting body.

SUMMARY OF THE INVENTION

It is accordingly a primary object of the present invention to provide a method and apparatus which will solve the above problems which are encountered in connection with horizontal continuous casting of alloys of the above type.

Thus, it is an object of the present invention to provide as simple a structure as possible for achieving continuous horizontal casting in a minimum vertical space with an uninterrupted continuous horizontal casting of metal alloys of the above type, particularly brass, for achieving a smooth, crack-free casting of constant diameter which is free of blowholes, cavitations, and undesirable inclusions of foreign bodies, even when the horizontal continuous casting mold is utilized over a long operating time.

Thus, it is an object of the present invention to provide a method and apparatus capable of achieving by horizontal continuous casting elongated solid cast bodies which are vastly superior to those which previously could be achieved and which are substantially free of any faults.

It is furthermore an object of the present invention to provide a construction according to which it is possible in a simple and inexpensive manner to exchange part of a refractory lining of the mold when this lining becomes worn.

In addition, it is an object of the present invention to provide a method and apparatus of the above type which will reliably prevent formation of undesirable deposits at the inner surface of the horizontal mold.

Furthermore, it is an object of the present invention to provide a method and apparatus according to which passages through which an inert gas is supplied to the interior of the mold are prevented from becoming clogged.

In accordance with the method of the invention, the continuous casting is carried out in a horizontal tubular mold which has opposed open entrance and discharge ends, with the material which is continuously cast being a metal alloy which has a tendency for one of its components to separate out in vapor form during and shortly after solidification of the metal alloy. In accordance with the method of the invention the entrance end of the horizontal mold is maintained in communication with and filled by the metal alloy in molten form, so that the molten metal alloy enters the mold through the entrance end thereof and continuously progresses therethrough toward the discharge end thereof while solidifying the mold in advance of the discharge end thereof at least next to the inner surface of the mold with the solidified metal alloy shrinking inwardly away from the inner surface of the mold to define therewith a shrinkage gap extending from a location where the solidified metal skin of the casting initially shrinks inwardly away from the mold up to the discharge end thereof. Within this shrinkage gap there is maintained around the entire surface of the casting which has shrunk inwardly from and is surrounded by the inner mold surface a gas which is inert to the vapor which tends to be formed by a component of the metal alloy during and shortly after solidification thereof.

The apparatus of the invention for continuously casting a metal alloy which has a tendency for a component thereof to separate in vapor form during and shortly after solidification of the metal includes an elongated tubular horizontal mold means having opposed open ends one of which is an entrance end for receiving molten metal and the other of which is a discharge end through which the casting continuously discharges from the mold means with the metal progressing from the entrance toward the discharge end of the mold means while solidifying therein at least next to an inner surface of the mold means in advance of the discharge end thereof. The solidified metal shrinks inwardly away from the inner surface of the mold means to define with this inner surface a shrinkage gap which surrounds the metal and extends from the location where the metal initially shrinks away from the inner surface up to the discharge end of the mold means. A supply means communicates with the entrance end of the mold means for supplying molten metal thereto and for maintaining the entrance end of the mold means filled with molten metal. The mold means includes an annular wall structure which is formed with a passage means which is adapted to communicate with a source of gas which is inert to the above vapor. This passage means terminates at the inner surface of the mold means in a plurality of openings distributed circumferentially about the axis of the mold means and situated at a substantial distance from the discharge end thereof in communication with the above shrinkage gap for introducing into this gap the inert gas which fills the gap, while issuing therefrom at the discharge end of the mold means, to prevent oxidation of the vapor.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
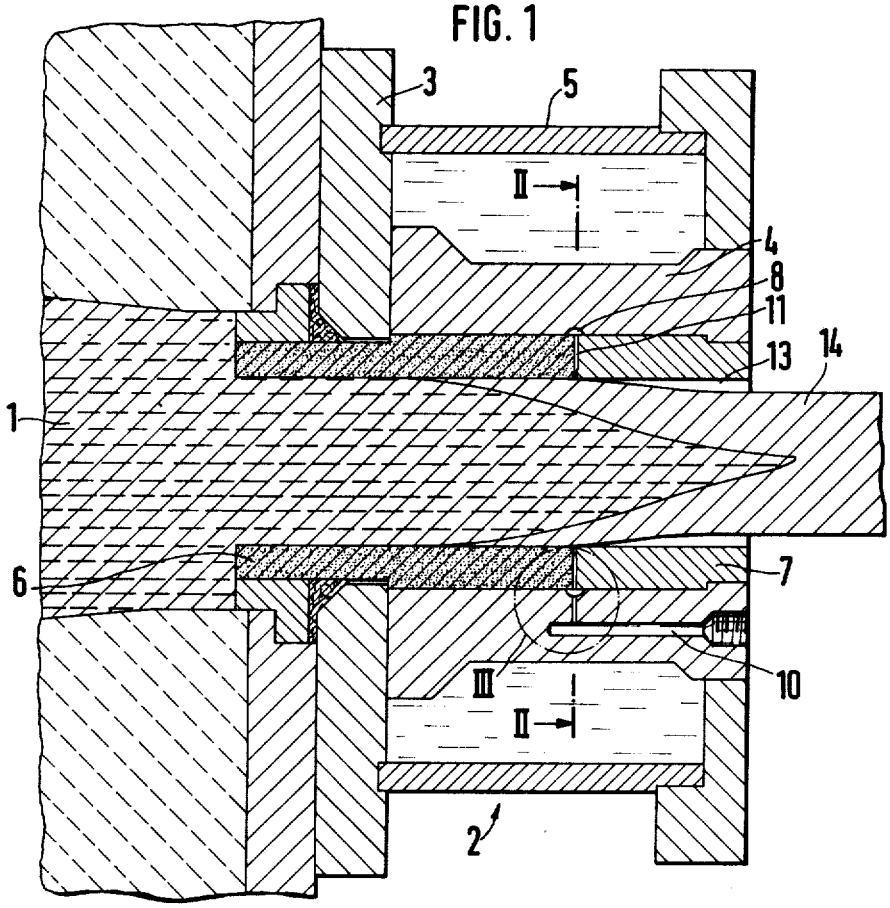
FIG. 1 is a fragmentary schematic sectional elevation of one possible structure of the invention for carrying out the method of the invention, the structure being shown in FIG. 1 in a plane which contains the axis of the mold means.

Referring now to FIG. 1 of the drawings, it will be seen that the illustrated structure includes an elongated horizontal mold means 2 which has opposed ends one of which is an entrance end, shown at the left in FIG. 1, for receiving molten metal, and the other of which is a discharge end, shown in the right of FIG. 1, through which the casting discharges from the mold means 2 in a continuous manner, as shown schematically for the casting 14 in FIG. 1. The mold means 2 includes a wall structure of annular configuration, surrounding the horizontal central axis of the mold means. This wall structure includes at the left in FIG. 1 an inner refractory lining 6 made of graphite and defining part of the inner surface of the mold means 2 as well as defining the open entrance end thereof through which the molten metal enters the mold means 2. The wall structure of the mold means 2 also includes an outer refractory lining 7 which has an inner end situated directly next to the outer end of the inner refractory lining 6 so that the lining 7 defines the remainder of the inner surface of the mold means 2. This refractory lining 7 of tubular configuration can be made of a material such as gray cast iron which has a high carbon content.

The entrance end of the mold means 2 is in permanent communication with a supply means 1 which may take the form of the fragmentarily and schematically illustrated furnace from which the molten metal is derived or the supply means 1 may take the form of a suitable intermediate container situated between the furnace and the entrance end of the mold means 2 in the manner illustrated. The supply means 1 thus maintains the entrance end of the mold means 2 not only supplied with molten metal but also filled with molten metal as illustrated. This molten metal of course progresses to the right, as viewed in FIG. 1, from the entrance end toward the discharge end of the mold means while solidifying therein at least next to the inner surface of the mold means in the manner illustrated in FIG. 1.

As is schematically shown in FIG. 1, the mold means 2 is fixed to the furnace 1 by way of a flange 3. Moreover, the mold means 2 includes at its annular wall structure an elongated tubular inner wall member 4 which surrounds and engages the inner lining 6 and the outer lining 7 of this wall structure. This inner tubular wall 4 is surrounded by and spaced from an outer tubular wall 5 which together with the wall 4 is connected at one end to the flange 3 while the outer ends of the tubular coaxial walls 4 and 5 are also fluid-tightly connected to an outer wall which projects outwardly from the outer end of the wall 4 in the manner illustrated. In this way this structure which includes the components 3–5 and the outer right end wall shown in FIG. 1 forms a cooling jacket through which a coolant such as water is circulated in a known manner.

The above-described wall structure of the mold means 2 is formed with a passage means which is adapted to communicate with a source of gas which is inert to a component of the metal alloy 14 which tends to separate from the metal during and shortly after solidification thereof with this separated component taking the form of a vapor. Thus it will be seen that when the outer skin of the casting first solidifies it shrinks shortly thereafter so as to become displaced inwardly away from the inner surface of the mold means to define therewith the elongated shrinkage gap 13 which extends from the location where the solidified metal initially shrinks inwardly away from the inner surface of the mold means all the way up to the discharge end thereof, this gap 13 surrounding the outer solidified surface of the metal 14 as illustrated. This passage means which is formed in the annular wall structure of the mold means communicates with the gap 13 adjacent the location where the metal initially shrinks inwardly away from the inner surface of the mold means to supply the gap 13 with the inert gas which travels together with the metal toward the right, as viewed in FIG. 1, so as to discharge with the metal from the open discharge end of the mold means, the inert gas taking the form of an annular stream of gas which surrounds and engages the exterior surface of the metal 14 travelling through the shrinkage gap 13.

Figure 2:
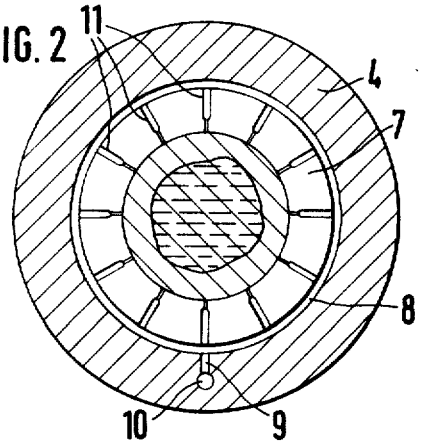
FIG. 2 is a transverse section of the structure of FIG. 1 taken along line II—II of FIG. 1 in the direction of the arrows.
Figure 3:
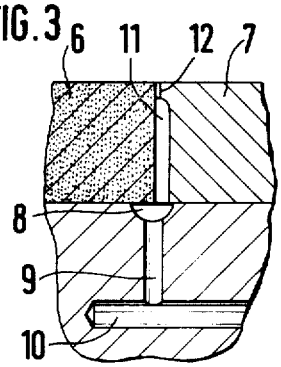
FIG. 3 is a view of that portion of FIG. 1 which is shown in the dot-dash line circle III, this portion of FIG. 1 being shown in FIG. 3 at an enlarged scale for illustrating more clearly details of the structure.

The above passage means includes a ring-shaped opening 8, this opening 8 taking the form of a circular inner groove formed at the inner surface of the wall 4 substantially midway between the ends thereof and surrounding the junction between the linings 6 and 7, as illustrated. This circular ring-shaped opening 8 is also illustrated in FIG. 2. As is indicated in FIG. 3, the ring-shaped opening 8 communicates through a radial bore 9 in the tube 4 with an axial bore 10 which is formed in the wall of the tube 4. The outer end of the axial bore 10 is enlarged and internally threaded so as to be capable of connection with a supply line through which the passage means which includes the opening 8 and bores 9 and 10 is placed in communication with a source of inert gas such as, for example, argon or nitrogen.

The passage means which is formed in the wall structure of the mold means includes a plurality of radial bores 11 which communicate at their outer ends with the ring-shaped opening 8 and which terminate at their inner ends in a plurality of openings distributed circumferentially about the axis of the mold means and situated adjacent the location where the solidified metal of the casting 14 initially shrinks inwardly away from the inner surface of the mold means. According to one of the features of the invention the bores 11 are formed by a plurality of radial grooves which are formed in the inner end surface of the outer lining 7, this inner end surface being situated directly next to the outer end surface of the inner lining 6, so that this outer end surface of the inner lining 6 extends across and closes the grooves 11 to define therewith the radial bores which are uniformly distributed about the axis of the mold means, as indicated in FIG. 2. According to yet another feature of the invention, the bores 11 have inner end regions 12 which are of a reduced cross section as compared with the remainder of the bores 11. Thus it is these inner end regions 12 which terminate in the openings of the bores 11 at the inner surface of the mold means. The smaller end regions 12 have at a maximum a length of one millimeter and are of a cross-sectional area which at a maximum is 0.5 $mm^2$. In this way as the inert gas flows into the gap 13 it will undergo a fairly sharp reduction in pressure while travelling through the inner end regions 12 of the bores 11, with the speed of flow of the inert gas of course increasing at the inner end regions 12 so that in this way clogging of the radial bores 11 and of the remainder of the passage means will be avoided.

During the casting operation with the above apparatus, the inert gas such as, for example, argon or nitrogen, is delivered through the above passage means, namely through the bores 10, 9, and the ring-shaped opening 8 into the radial bores 11 to issue therefrom into the shrinkage gap 13 between the casting 14 at least at the part thereof which has solidified at its outermost skin and the inner surface of the mold means, in the illustrated example the inner surface of the outer liner 7. This inert gas flows in the same direction that the metal progresses from the entrance end toward the discharge end of the mold means and discharges from the mold means at the discharge end thereof. In this way atmospheric oxygen is prevented from entering into the shrinkage gap 13. As a result the separated metal component of the alloy, which is in vapor form in the gap 13, cannot become oxidized. In addition, experience has shown that not only is it possible in this way to prevent undesirable deposits from forming at the inner surface of the mold means, but also the molten metal deposited from the vapor in the gap 13 at the inner surface of the liner 7 will act as a lubricant. Thus, in the case where the alloy is brass, molten zinc will be deposited from the vapor and will remain in molten, liquid form to act as a lubricant for the casting which travels through the outer liner 7.

Thus, in accordance with the invention an inert gas is introduced into the shrinkage gap surrounding the horizontal continuously cast metal, with this inert gas travelling through the shrinkage gap while surrounding and engaging the entire exterior surface of the solidified metal from the location where this solidified metal initially shrinks inwardly away from the inner mold surface all the way up to the discharge end of the mold means, with this inert gas streaming out of the discharge end of the mold means in the manner described above. In this way it is possible to continuously cast an alloy such as brass in a horizontal mold without requiring the addition of any lubricating medium, while achieving even during relatively long intervals of continuous operation the result of preventing any deposits from clinging to the inner surface of the mold means, so as to avoid the undesirable results which would follow from the presence of such deposits.

The achievement of this latter unexpected result can be explained by the fact that the undesirable deposits at the inner surface of the mold means which have been observed up to the present time are not actually in the form of metal deposited from the vapor which separates from the alloy, but rather these deposits are in the form of a metal oxide such as, for example, zinc oxide in the case of brass. Thus, the undesirable metal deposits at the inner surface of the mold encountered with conventional methods and apparatus results from the fact that air enters into the shrinkage gap and results in oxidation of the metal component of the alloy which is in vapor form. Such metal oxide deposits, which conventionally also contain metallic inclusions in the form of small metallic bodies, are extremely hard and cling very strongly to the inner surface of the mold, thus forming the primary cause for the disadvantages encountered in continuous horizontal casting of alloys, particularly brass, which have a tendency for a component thereof to become separated in vapor form during and shortly after solidification of the metal. Inasmuch as with the present invention it becomes possible to maintain the outer air out of the shrinkage gap, it is not possible for the separated alloy component in vapor form to become oxidized, so that it is clear that as a result the inner surface of the mold means will be maintained free from any deposits clinging thereto.

As indicated above, it is of advantage to introduce the inert gas through the above-described radial bores 11 which are connected by the ring-shaped opening 8 with the source of inert gas. Certain manufacturing advantages and a relatively inexpensive exchange, when required, of the liner due to wear thereof, are brought about by making the refractory lining of the two separate components 6 and 7 which butt against each other with the radial bores taking the form of the radial grooves at the inner end surface of the outer liner 7, these grooves of course being closed by the outer end surface of the inner liner 6. Thus this type of construction for the passage means is highly advantageous from a manufacturing standpoint, while at the same time the fact that the liner is made of two sections renders exchange thereof due to wear, whenever required, relatively inexpensive and simple to carry out.

However, a substantial improvement in the capability of the mold to continue to operate over a long interval without any problems results from the fact that the inner liner 6 is made of graphite while the outer liner 7 is made of a wear-resistant metal with respect to which the separated alloy component in vapor form has little tendency to cling. Thus, it is preferred to make the outer liner component 7 of the mold means of a metal such as molybdenum or, as pointed out above, a gray cast iron which has a high carbon content.

As was pointed out above, in order to prevent clogging of the radial bores, their construction is such that there is a fairly sharp drop in pressure at the region where these bores open into the interior of the mold, this result being brought about by providing the radial bores 11 with their smaller inner end regions 12 each of which, as pointed out above, has a maximum length on the order of one millimeter and a cross-sectional area which at a maximum is on the order of 0.5 $mm^2$.

What is claimed is:

1. In a method of continuously casting, in a horizontal tubular method which has opposed open entrance and discharge ends, a metal alloy which has a tendency for one of its components to separate out in vapor form during and shortly after solidification of the metal alloy, comprising the steps of maintaining the entrance end of the horizontal mold in communication with and filled by the metal alloy in molten form, so that the molten metal alloy enters the mold through said entrance end thereof and continuously progresses therethrough toward said discharge end thereof while solidifying in the mold in advance of said discharge end thereof at least next to the inner surface of the mold through which the metal alloy is indirectly cooled with the solidified metal alloy shrinking inwardly away from the inner surface of the mold to define therewith a shrinkage gap extending from a location where the solidified metal skin of the casting initially shrinks inwardly away from the mold up to the discharge end thereof, said shrinkage gap thus being solely defined by the outer solidified skin of the casting and the inner surface of the mold, and introducing into said shrinkage gap around the entire surface of the casting which has shrunk inwardly from and is surrounded by the inner mold surface a gas which is inert to the vapor which tends to be formed by a component of the metal alloy during and shortly after solidification thereof, said inert gas being introduced into said shrinkage gap simultaneously from a plurality of mold openings distributed circumferentially about the mold axis and situated at the region of said location where the metal skin of the casting initially shrinks inwardly away from the inner mold surface and in a manner such that the gas does not at any time interface with the molten metal alloy.

2. In a method as recited in claim 1 and wherein the metal alloy is brass.

3. In a method as recited in claim 2 and wherein said inert gas is selected from the group consisting of nitrogen and argon.

4. In a method as recited in claim 1 and wherein the inert gas is selected from the group consisting of nitrogen and argon.

5. In a method as recited in claim 1 and including the step of maintaining said shrinkage gap open from said location all the way up to said discharge end of said mold so that the introduced inert gas flows in the same direction that the metal progresses through the mold and issues from said gap at said discharge end of said mold in the form of an annular stream which surrounds the solidified metal issuing from the mold.

* * * * *